US008247673B1

(12) United States Patent
Reboul

(10) Patent No.: US 8,247,673 B1
(45) Date of Patent: Aug. 21, 2012

(54) STRING TUNING ORBITAL WITH ERGONOMIC FEATURES

(76) Inventor: Laurent Reboul, San Anselmo, CA (US)

( * ) Notice: Subject to any disclaimer, the term of this patent is extended or adjusted under 35 U.S.C. 154(b) by 0 days.

(21) Appl. No.: 13/157,576

(22) Filed: Jun. 10, 2011

Related U.S. Application Data

(63) Continuation-in-part of application No. 29/388,466, filed on Mar. 29, 2011.

(51) Int. Cl.
*G10D 3/12* (2006.01)

(52) U.S. Cl. ..... 84/304

(58) Field of Classification Search ..... 84/304–306, 84/312 R
See application file for complete search history.

(56) References Cited

U.S. PATENT DOCUMENTS 6,184,452 B1 2/2001 Long et al.
7,592,528 B2 9/2009 Lyles
7,659,465 B1 2/2010 McEwen
7,973,225 B2 * 7/2011 Goto ..... 84/306

* cited by examiner

*Primary Examiner* — Kimberly Lockett
(74) *Attorney, Agent, or Firm* — Steven A. Nielsen; Allman & Nielsen, P.C.

(57) ABSTRACT

A string tuning system useful for both acoustic and amplified instruments provides a nondestructive method and kit to replace existing thumb peg tuning controls with ergonomic orbital controls. Orbital controls are sometimes referred to as "orbs" and may comprise round tuning knobs that make string manipulation ergonomic. In one embodiment, a tuning assembly 800 comprises a headstock bolt 650, comprising a threaded shaft section 651 and nut section 652, with the headstock bolt 650 fitting into the housing 506 of the string attachment shaft 500. The main wall 103 of the orb contains a perpendicular orb void 105, the orb void 105 being sometimes used to accept an orb set screw 106. The orb 100 also comprises an interior center vertical void 104, the interior center vertical void 104 sometimes used to accept an orb collar 107. The orb collar 107 comprising a main pipe like body 114, a bottom edge 109, a top edge 110, an interior vertical void 111 and a perpendicular void 108.

4 Claims, 16 Drawing Sheets

STRING TUNING ORBITAL WITH ERGONOMIC FEATURES

RELATED PATENT APPLICATION AND INCORPORATION BY REFERENCE

This is a utility application is a continuation in part application or a continuation of U.S. patent application 29/388,466 filed on Mar. 29, 2011. This related application is incorporated herein by reference and made a part of this application. If any conflict arises between the disclosure of the invention in this utility application and that in the related application, the disclosure in this utility application shall govern. Moreover, the inventor(s) incorporate herein by reference any and all patents, patent applications, and other documents hard copy or electronic, cited or referred to in this application.

COPYRIGHT AND TRADEMARK NOTICE

This application may include material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION (1) Field of the Invention

The invention generally relates to means and methods of adjusting and retaining tension of strings used with musical instruments. More particularly, the invention relates to new means and methods of using and securing an orb type tension adjustment article into a tuning mechanism.

(2) Description of the Related Art

String tension systems are known in the related art. For example, U.S. Pat. No. 7,592,528 granted on Sep. 22, 2009 to Lyles et al discloses a complex system of springs and visual indicators to keep a string tensioned to a desired frequency. The system of Lyles is not well suited for retro fitting existing instruments and is unduly complex and bulky.

U.S. Pat. No. 6,184,452 granted on Feb. 6, 2001 to Long et al discloses an intricate solenoid, gear box and motor system to automatically adjust string tension. While Long makes clever use of a power control board and a microcontroller, Long is not well suited for acoustical guitars where a power supply is not often found.

More recently, U.S. Pat. No. 7,659,465 granted to McEwen on Feb. 9, 2010 disclosed a headstock based system for increasing the number of strings used on a string instrument. While McEwen does show a rounded tuning article, McEwen fails to disclose means of securely adding a rounded tuning piece to a tuning system.

BRIEF SUMMARY OF THE INVENTION

The present invention overcomes shortfalls in the related art by presenting an unobvious and unique combination, configuration and use of spring washers, friction reducing washers, orb shafts with flat vertical sides, orb collars, tuning orbs with interior center voids and perpendicular voids and other components to achieved unexpected results in retro fitting existing tuners with ergonomically desirable tuning orbitals. Embodiments of the invention may be used to add tuning systems to new string instruments, provide a total replacement for existing headstock tuners, or to replace several parts of an existing headstock based tuning system.

Embodiments of the invention allow for retrofitting existing tuning systems that typically use awkward flat head or thumb screws to adjust string tension. In one embodiment of a disclosed retrofit kit, specialized components comprising a spring washer, friction reducing washer, orb collar, orb set screw and orb are attached to an existing tuning shaft, replacing thumb keys and thumb key attachment components.

A specialized orb or orbital tuner knob features an interior center void and a connecting perpendicular orb set screw void. An orb collar comprises an outer symmetrical circular surface that fits into a symmetrical interior center void of an orb knob. The orb collar has a hollow and cylindrical center void. The cylindrical wall of the orb collar has one or more perpendicular voids, the void(s) being used to accept an orb set screw. In one embodiment, the inner center vertical void within the orb is symmetrical and the outer surface of the orb collar is also symmetrical.

In one contemplated sequence of operations, a thumb key and related hardware is removed from a tuning piece, exposing a tuning shaft. The exposed tuning shaft will have one or two flat vertical sides. Using embodiments of the disclosed invention, a friction reducing washer is placed upon the tuning shaft, followed by a spring washer. The spring washer does not lay flat upon the friction reducing washer as the spring washer is irregular in shape. When loaded the spring washer deflects, like a spring, and provides a preload between the friction reducing washer and the lower end of the orb collar.

An orbital tuning article, orb tuning knob or orb has a vertical center void and perpendicular void. In one contemplated embodiment an orb collar is a pipe like structure, taking the shape of a cylinder having a circular outer wall and an circular inner wall, leaving a center void. In one embodiment, the orb collar has one perpendicular set screw void. The orb collar is inserted into the vertical center void of the orb and rotated until an alignment is achieved with the perpendicular orb void and the perpendicular set screw void of the orb collar. The tuning shaft, having a friction reducing washer and spring washer, in inserted into the orb collar, with the orb collar already within the orb tuner. An orb set screw is then screwed through the perpendicular orb set screw void and then through the adjacent perpendicular set screw void of the orb collar, with the end of the orb set screw pressing against a flat vertical surface of the tuning shaft. Other sequences of operations and embodiments are contemplated.

In several contemplated embodiments the disclosed orb or orbitals include ergonomic functions and features. Orbs may be round and well textured to assist in tuning. Orbs may also simplify string tuning and string replacement of stringed instruments. Embodiments of the disclosure are not limited to any particular type of stringed instrument. For purposes of example only, acoustic and electrical guitars are illustrated.

REFERENCE NUMERALS IN THE DRAWINGS

Figure 1:
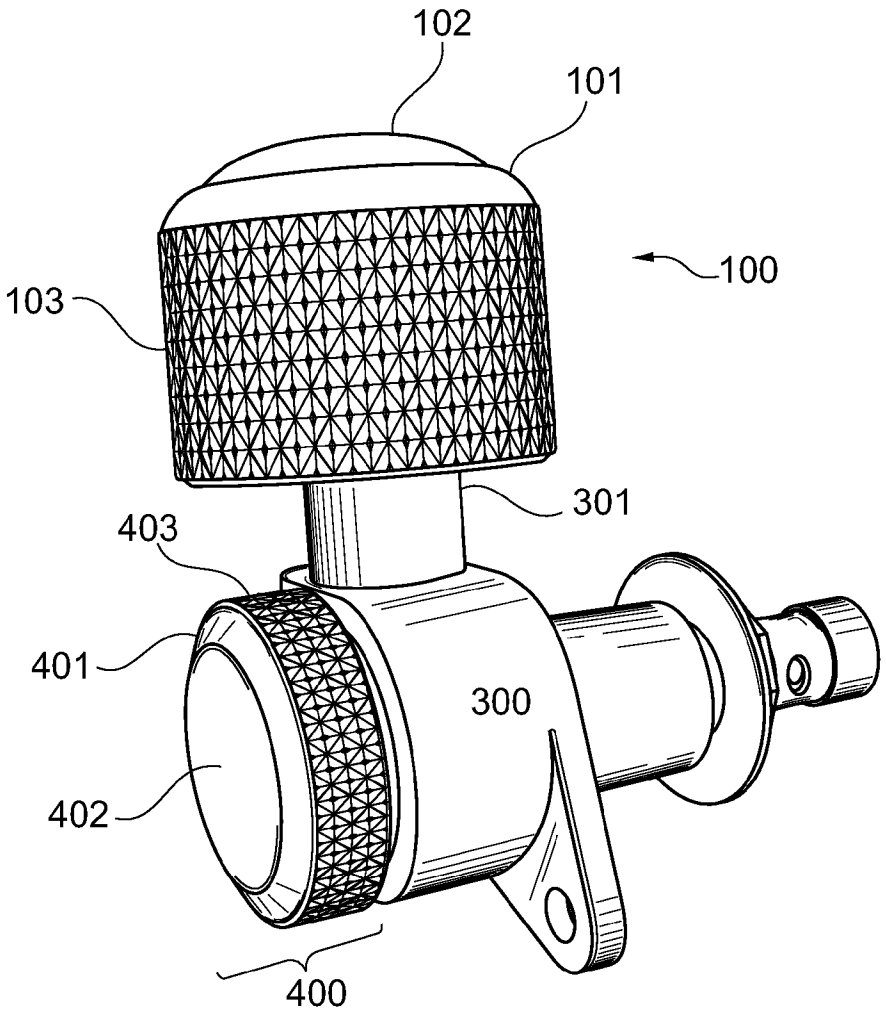
FIG. 1 is a front and side perspective view of a string tuning mechanism constructed in accordance with the principles of the present disclosure.

100 an orb, orbital, orb knob, orbital tuning article or orb tuning knob
101 shoulder of orb
102 crown of orb
103 main wall of orb
104 interior center vertical void within orb 100
105 perpendicular orb void sometimes used to accept a orb set screw 106
106 orb set screw
107 orb collar
108 perpendicular void with in orb collar
109 bottom edge of orb collar
110 top edge of orb collar
111 interior vertical void within orb collar
112 spring washer
113 friction reducing washer
114 main pipe like body of orb
115 front flat side of orb set screw, sometimes used to urge upon the flat vertical edge 303 of the tuning shaft
116 rear side of orb set screw, sometimes used to rotate the orb set screw
300 case of tuning assembly
301 housing of tuning shaft
302 tuning shaft
303 top edge of tuning shaft
304 top ledge of housing of tuning shaft
305 flat vertical edge of tuning shaft
400 locking nut
401 shoulder of locking nut
402 crown of locking nut
403 main wall of locking nut
404 inner bezel area of locking nut
500 string attachment shaft
501 outer collar of string attachment shaft
502 recessed winding area for string
503 inner collar of string attachment shaft
504 void for string, found within recessed winding area 502
506 housing for string attachment shaft, or string attachment shaft housing
600 torque leg of tuning assembly
601 void in torque leg
602 flat area of tuning assembly, sometimes used to abut a back side of a headstock
650 headstock bolt, comprising a threaded shaft section 651 and nut section 652
651 threaded shaft section of headstock bolt 650
652 nut section of headstock bolt 650
653 washer for headstock bolt 650
700 headstock font side
701 headstock back side
800 string tuning assembly These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

FIG. 1 presents a disclosed orb or tuning orb 100 comprising a crown 102, shoulder 101 and main wall 103. A housing 301, or tuning shaft housing, secures a tuning shaft, (not shown) the tuning shaft housing 301 rests upon a case 300 of the tuning assembly. A locking nut 400 is secured to the case 300 of the tuning assembly. The locking nut 400 comprises a shoulder 401, main wall 403 and crown 402.

Figure 2:
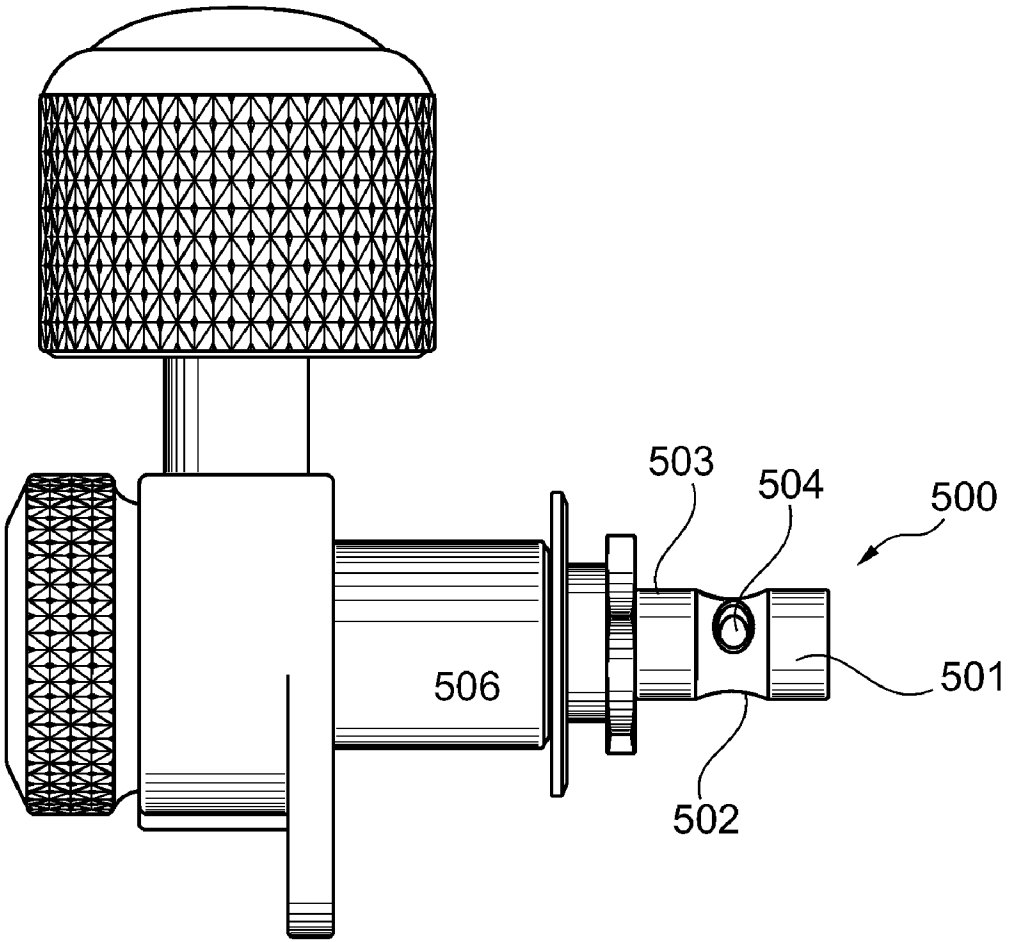
FIG. 2 is a left side view of a string tuning mechanism constructed in accordance with the principles of the present disclosure.

FIG. 2 presents a housing 506 used to secure a string attachment shaft. A string attachment shaft 500 comprises an outer collar 501, recessed winding area 502, void 504 for string or other vibrating material, and an inner collar 503.

Figure 3:
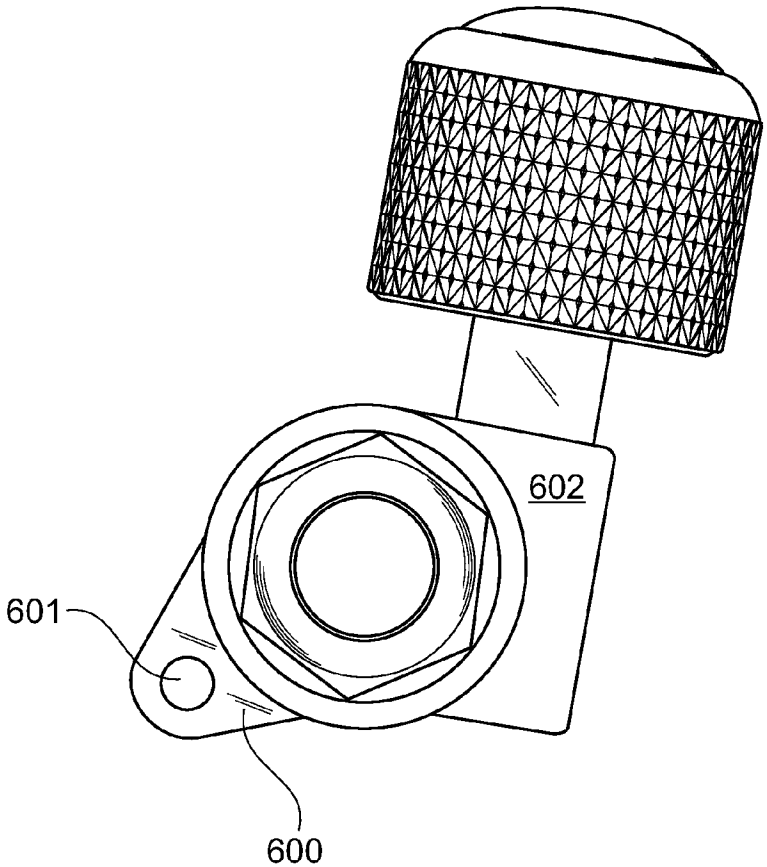
FIG. 3 is a right side view of a string tuning mechanism constructed in accordance with the principles of the present disclosure.

FIG. 3 presents a torque leg 600 of the tuning assembly, a void 601 within the torque leg. The void 601 of the torque leg is sometimes used with a screw to further attach the tuning assembly to a headstock. The flat area 602 of the tuning assembly is sometimes used to abut a back side of a headstock.

Figure 4:
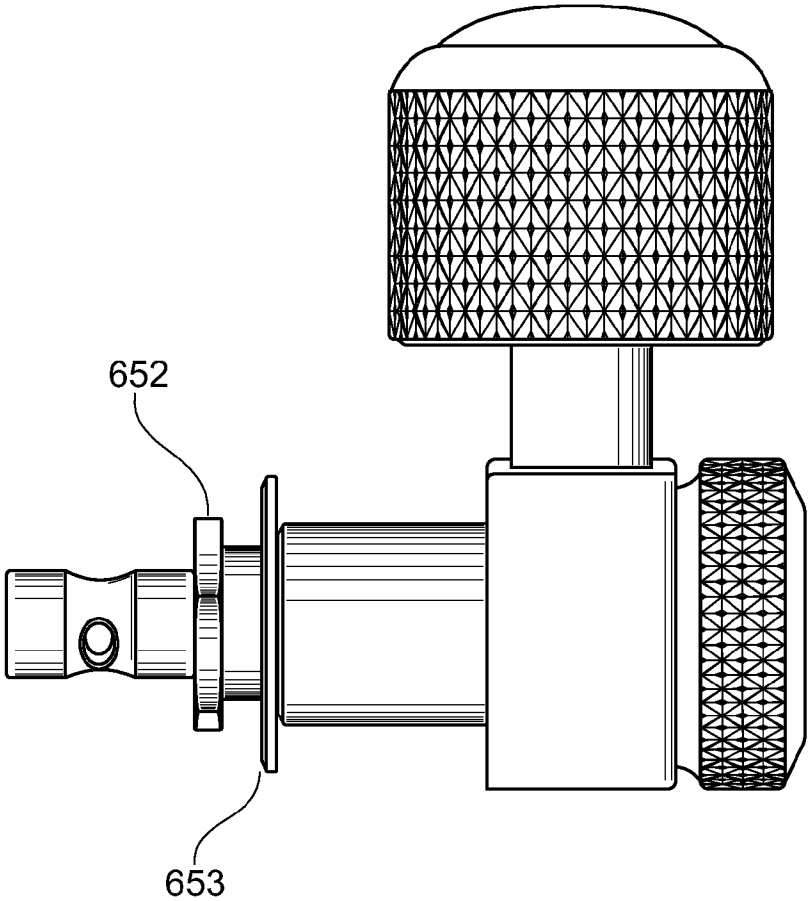
FIG. 4 is a back side view of a string tuning mechanism constructed in accordance with the principles of the present disclosure.

FIG. 4 presents a nut section 652 of a headstock bolt and a washer 653 of a headstock bolt.

Figure 5:
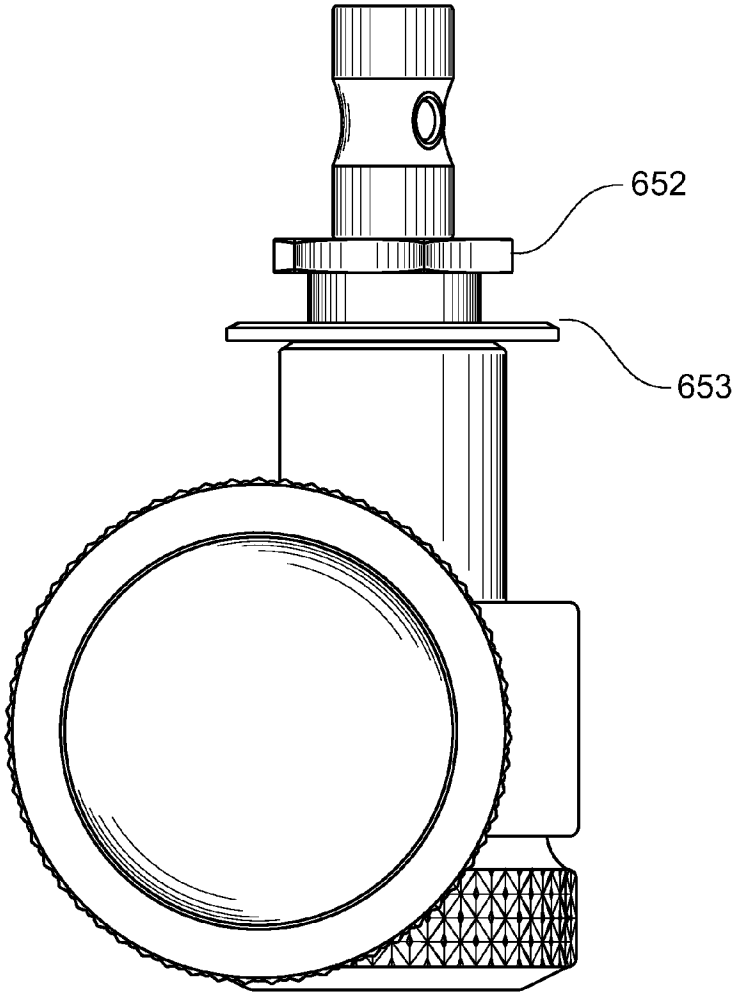
FIG. 5 is a front side view of a string tuning mechanism constructed in accordance with the principles of the present disclosure.

FIG. 5 presents another view of a nut section 652 of a headstock bolt and a washer 653 of a headstock bolt.

Figure 6:
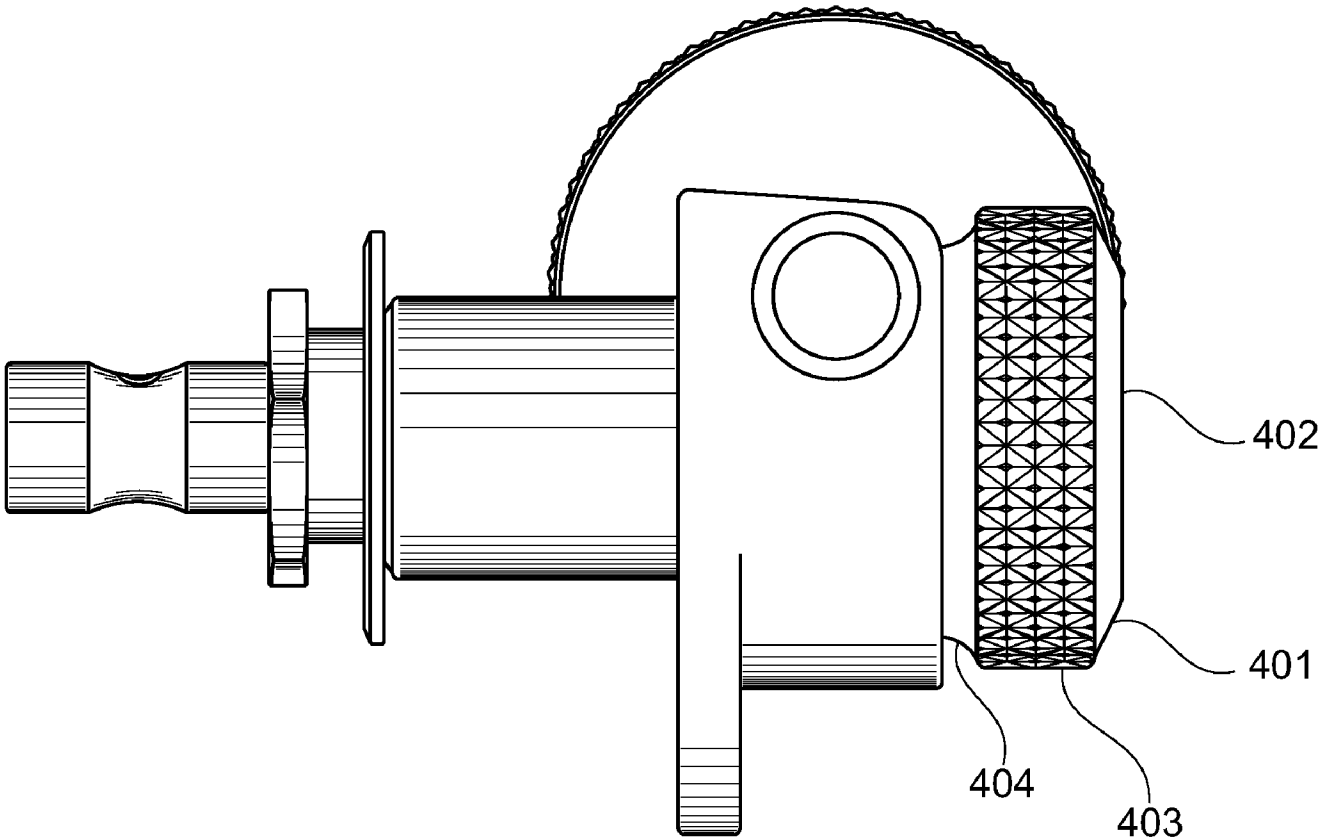
FIG. 6 is a top side view of a string tuning mechanism constructed in accordance with the principles of the present disclosure.

FIG. 6 presents an inner bezel area 404 of a locking nut, an adjacent main wall 403, a shoulder 401 and a crown 402.

Figure 7:
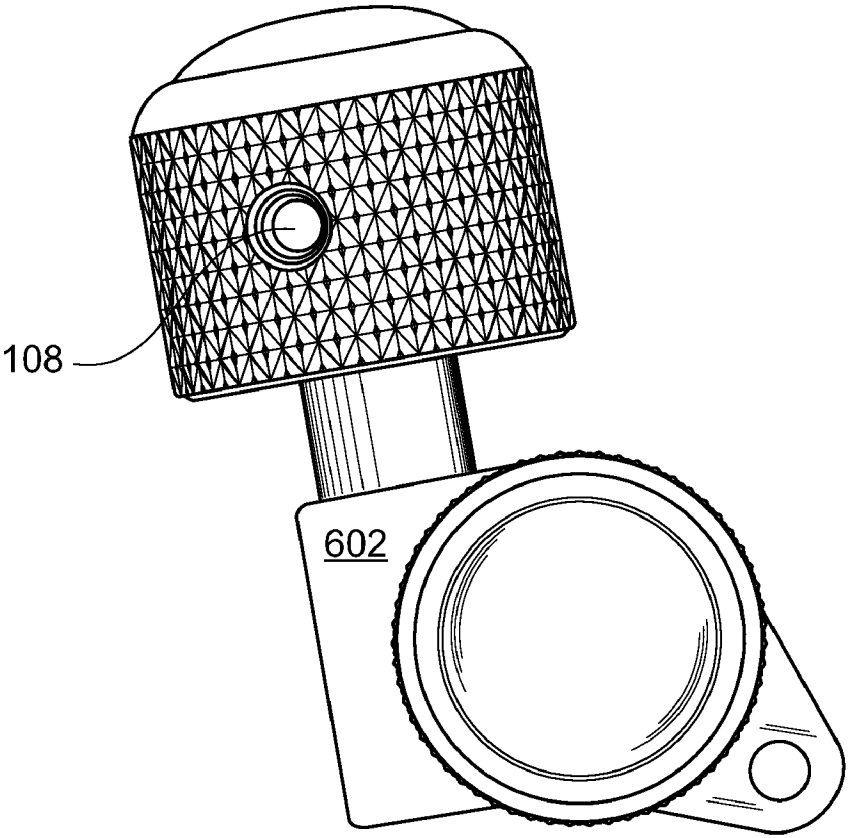
FIG. 7 is a bottom side view of a string tuning mechanism constructed in accordance with the principles of the present disclosure.

FIG. 7 presents a flat area 602 of the tuning assembly and a perpendicular void 108 within an orb collar.

Figure 8:
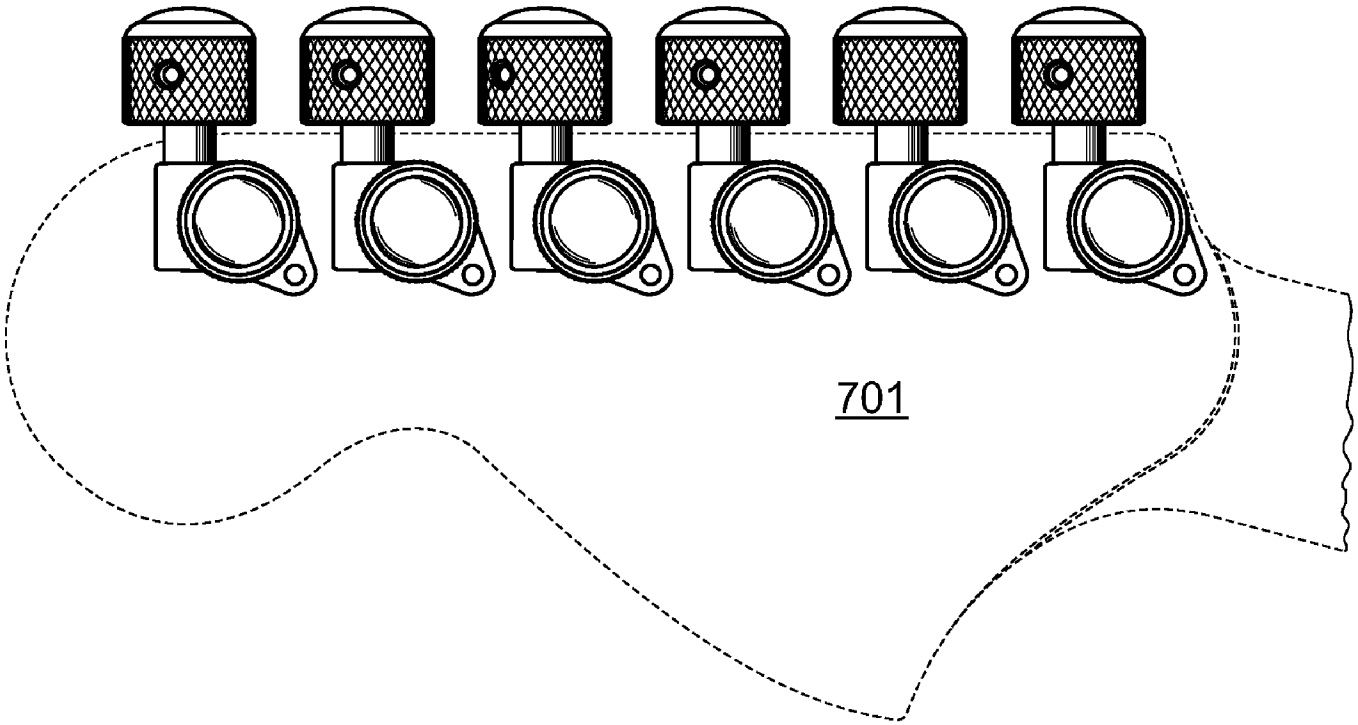
FIG. 8 is a back view of a disclosed string tuning mechanism installed into a guitar headstock.

FIG. 8 presents a headstock backside 701 with tuning assemblies.

Figure 9:
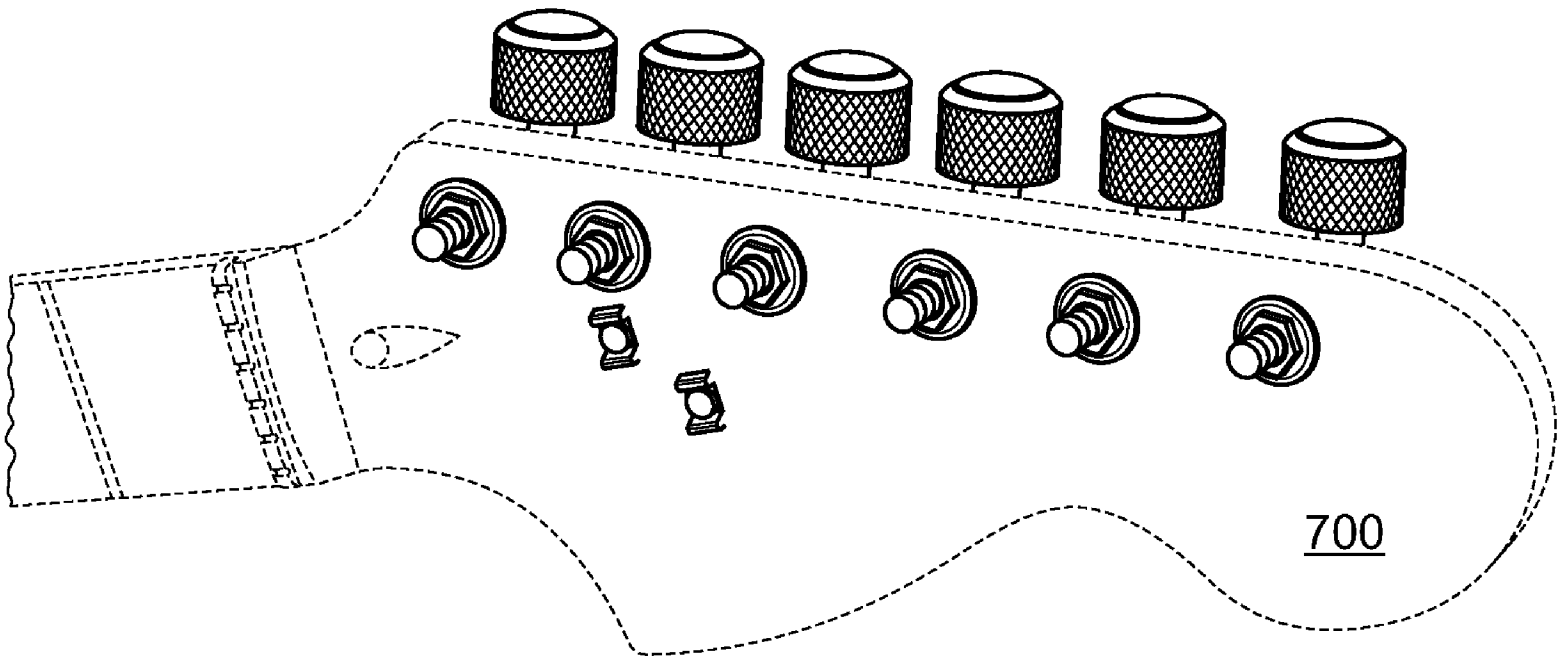
FIG. 9 is a front view of a disclosed string tuning mechanism installed into a guitar headstock.

FIG. 9 presents a front side 700 of a headstock with tuning assemblies.

Figure 10:
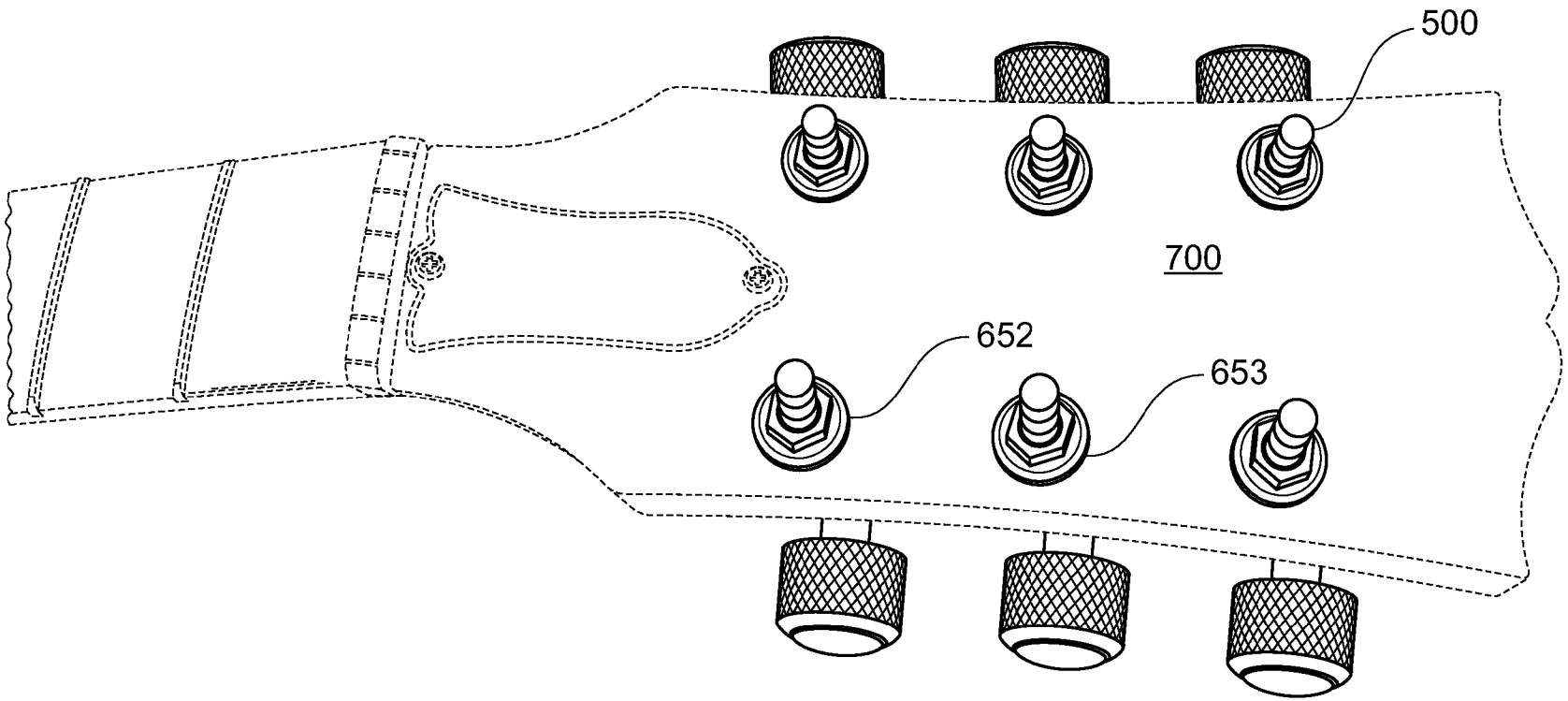
FIG. 10 is a back view of a disclosed string tuning mechanism installed into a guitar headstock.

FIG. 10 presents a front side 700 of a headstock with tuning assemblies and delineates one of several string attachments shafts 500, washers 653 for headstock bolts and exposed nut sections 652.

Figure 11:
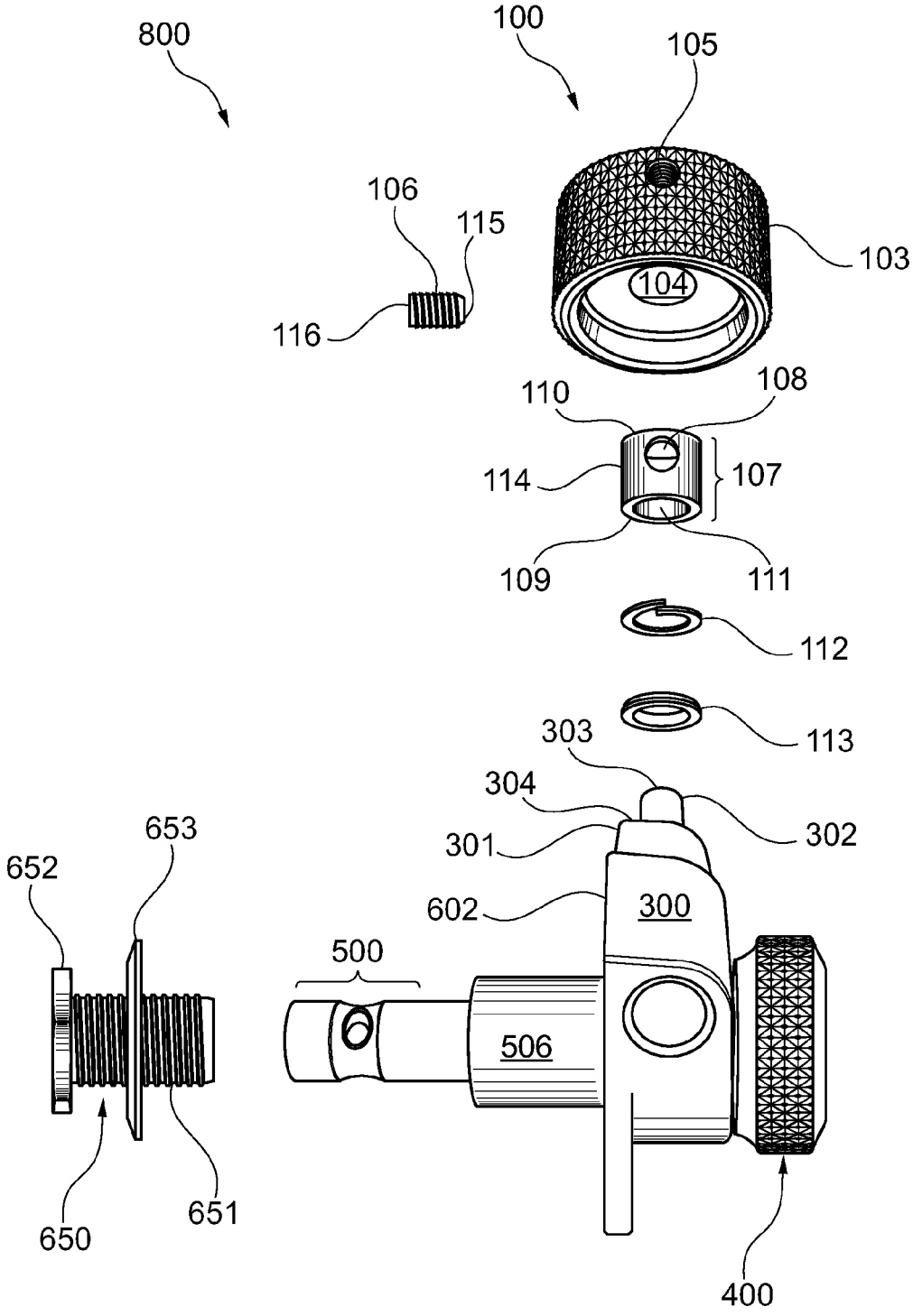
FIG. 11 is an exploded view of one contemplated embodiment.

FIG. 11 presents an exploded view of a tuning assembly 800 constructed in accordance with the principles of this disclosure. In one embodiment, a tuning assembly 800 comprises a headstock bolt 650, comprising a threaded shaft section 651 and nut section 652, with the headstock bolt 650 fitting into the housing 506 of the string attachment shaft 500. From the top of FIG. 11 the main wall 103 of the orb contains a perpendicular orb void 105, the orb void 105 being sometimes used to accept an orb set screw 106. The orb 100 also comprises an interior center vertical void 104, the interior center vertical void 104 sometimes used to accept an orb collar 107. The orb collar 107 comprising a main pipe like body 114, a bottom edge 109, a top edge 110, an interior vertical void 111 and a perpendicular void 108.

The case 300 of the tuning assembly supports a housing 301 for the tuning shaft 302. The tuning shaft housing 301 comprises a top ledge 304. The top ledge 304 of the tuning shaft housing 301 may support a friction reducing washer 113, a spring washer 112 and/or an orb collar 107.

Figure 12:
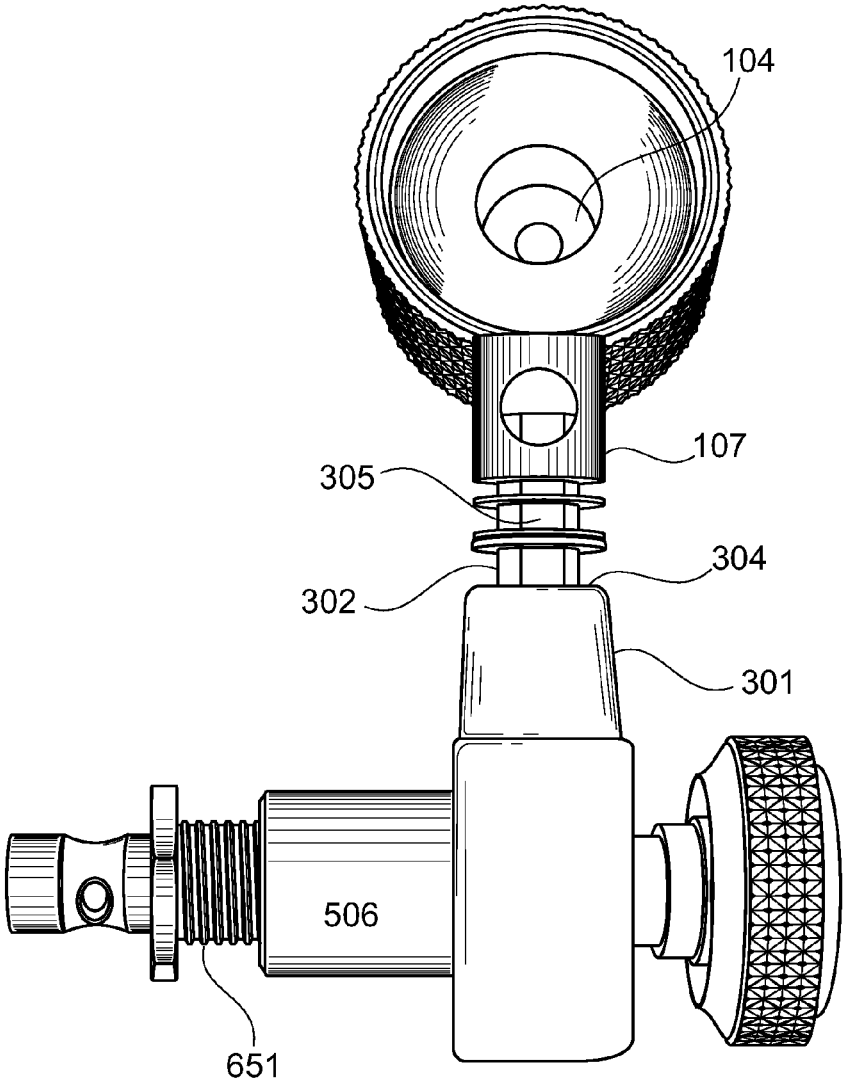
FIG. 12 is a partially assembled contemplated embodiment.

Referring to FIG. 12, a flat vertical edge 305 of the tuning shaft 302 aligns with the perpendicular void 108 of the orb collar. The perpendicular orb void 105 is aligned to the perpendicular void 108 of the orb collar, and the orb set screw 106, having a front flat side 115 is rotated upon a rear rotation side 116. The orb set screw's front flat side 115 travels though the orb and orb collar until pressed against the flat vertical edge 305 of the tuning shaft.

Referring back to FIG. 11, the tuning assembly may be fitted onto a headstock by placing a tuning headstock void, not shown, through the string attachment shaft 500 and housing 506 for the string attachment shaft, such that the backside 701 of a headstock rests upon the flat area 602 of the tuning assembly. As the string attachment shaft 500 is exposed on the front side 700 of a headstock, the headstock bolt, with washer 653 is placed through the string attachment shaft 500 and screwed into an interior threaded section of the string attachment housing. The nut section 652 of the headstock bolt may be rotated to screw in the headstock bolt 650 into the housing 506 of the string attachment shaft.

In one contemplated use, the locking nut 400 is loosened so as to allow the tuning orb to rotate, causing the string attachment shaft to tighten or loosen string.

In one contemplated assembly or method of installation, the orb collar 107 fits into the interior center vertical void 104 with in the orb, and the perpendicular void 108 of the orb collar aligns with the perpendicular orb void 105, allowing orb set screw 106 to initially secure the orb collar 107 into the interior center vertical orb void 104. Then, a friction reducing washer 113 is placed around the tuning shaft, such that the friction reducing washer 113 rests upon the top ledge 304 of the tuning shaft housing. A spring washer 112 is then placed around the tuning shaft 302 and on top of the friction reducing washer 112. The tuning shaft 302 having a top edge 303, is placed into the interior vertical void 108 within the orb collar, such that the bottom edge 109 of the orb collar rests upon the spring washer 112, and such that a front flat side 115 of the orb set screw rests upon a flat vertical edge 305 of a tuning shaft.

FIG. 12 presents the threaded shaft section 651 of a headstock bolt partially screwed into a housing 506 for a string attachment shaft. A housing 301 for a tuning shaft is shown having a top ledge 304 and a protruding tuning shaft 302. A friction reducing washer and spring washer are shown to be placed onto the tuning shaft. A flat vertical edge 305 upon the tuning shaft is shown to be perpendicular to the perpendicular void of the orb collar.

Figure 13:
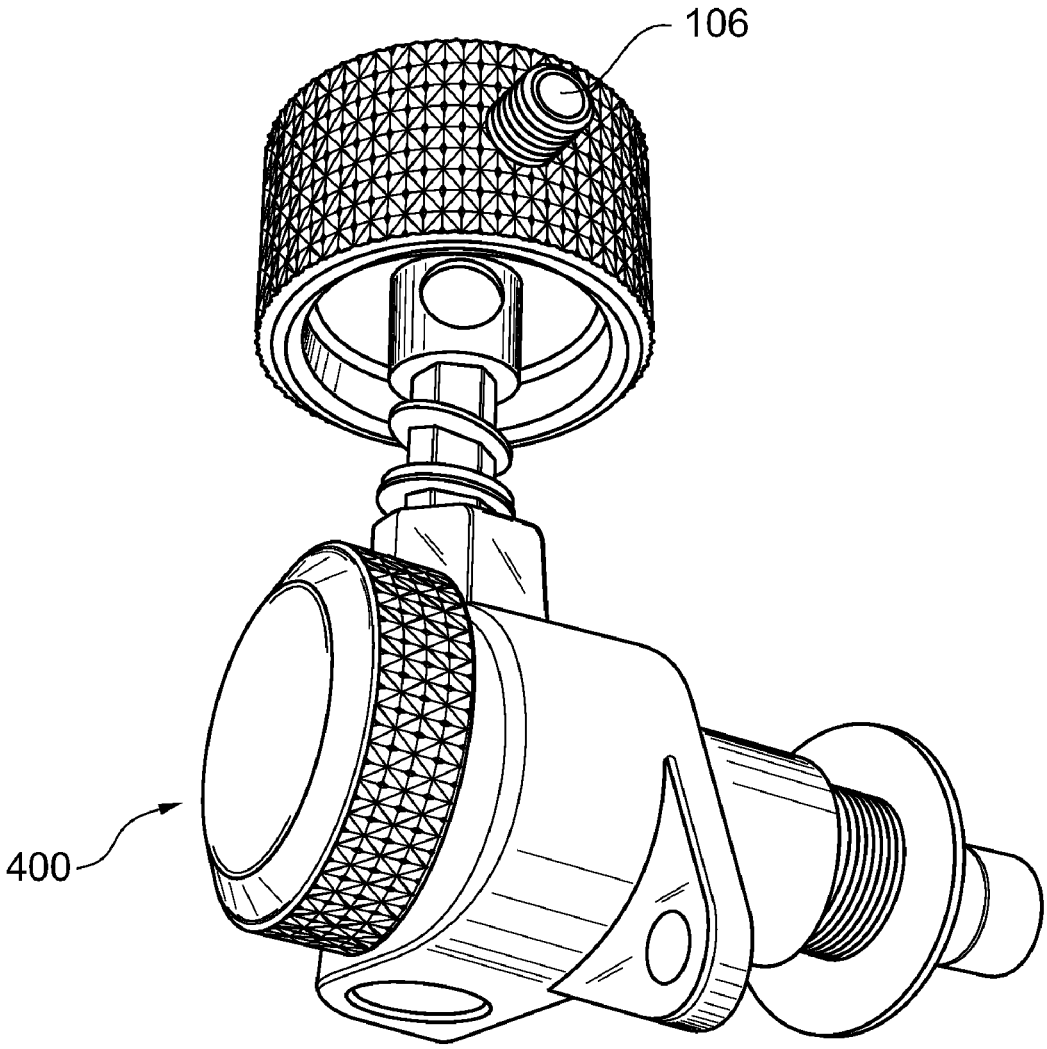
FIG. 13 is a nearly completed assembly of a contemplated embodiment.

FIG. 13 presents an orb set screw 106 partially inserted into an orb. An orb collar 107 is shown with a perpendicular void 108.

Figure 14:
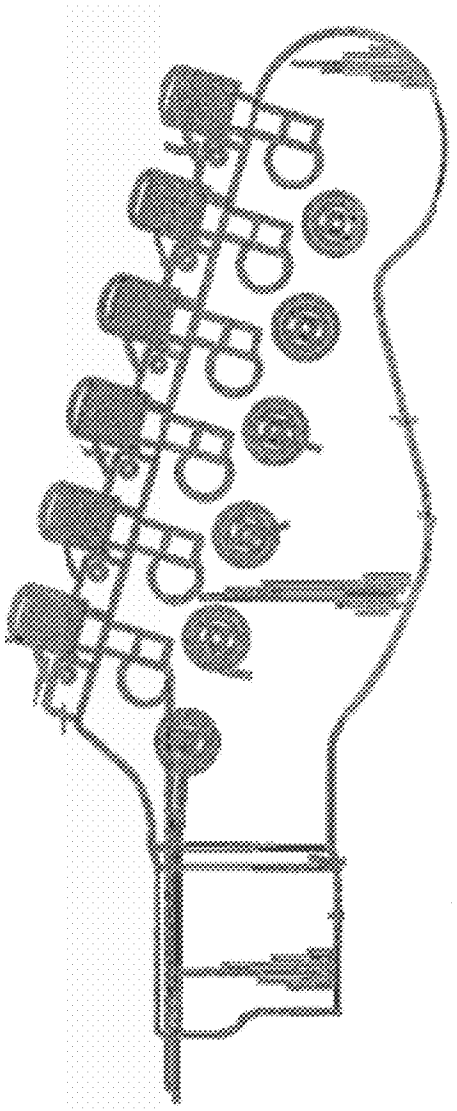
FIG. 14 (Prior Art)
FIG. 14 is a prior art example.

FIG. 14 presents a prior art drawing, FIG. 9 from U.S. Pat. No. 7,659,465 by Paul A. McEwen, granted Feb. 9, 2010. The McEwen disclosure shows the addition of new holes, voids or apertures to add tuners to headstocks. McEwen uses a steel flanged insert, a feature eschewed by the present disclosure.

Figure 15:
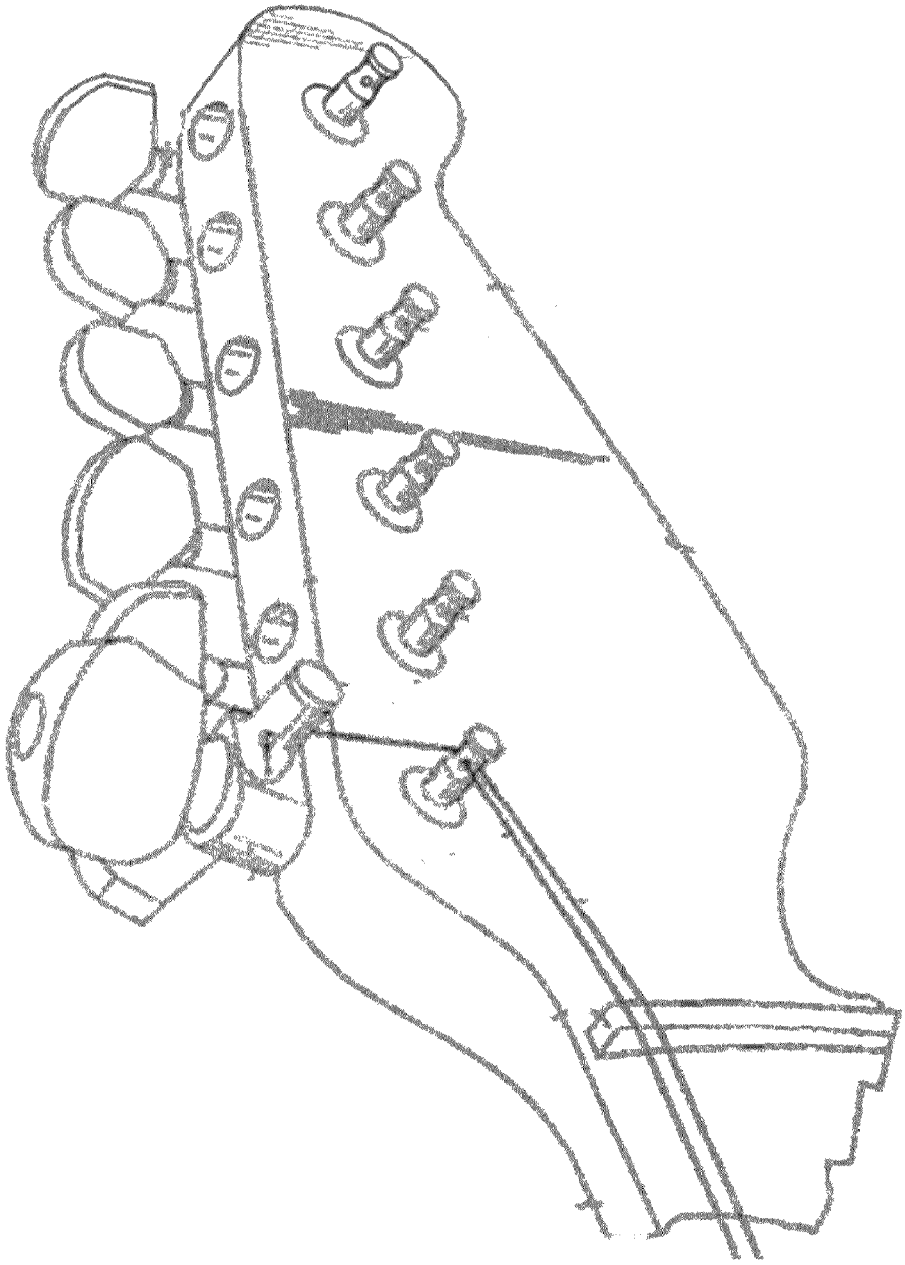
FIG. 15 (Prior Art)
FIG. 15 is a prior art example.

FIG. 15 presents a prior art drawings, FIG. 10 of the McEwen disclosure, showing a significant difference from the present disclosure. FIG. 10 of McEwen, (presented as FIG. 15 herein) shows a new drilling to create and add threads to a tuning barrel. There is no analogous assembly within the present disclosure.

Figure 16:
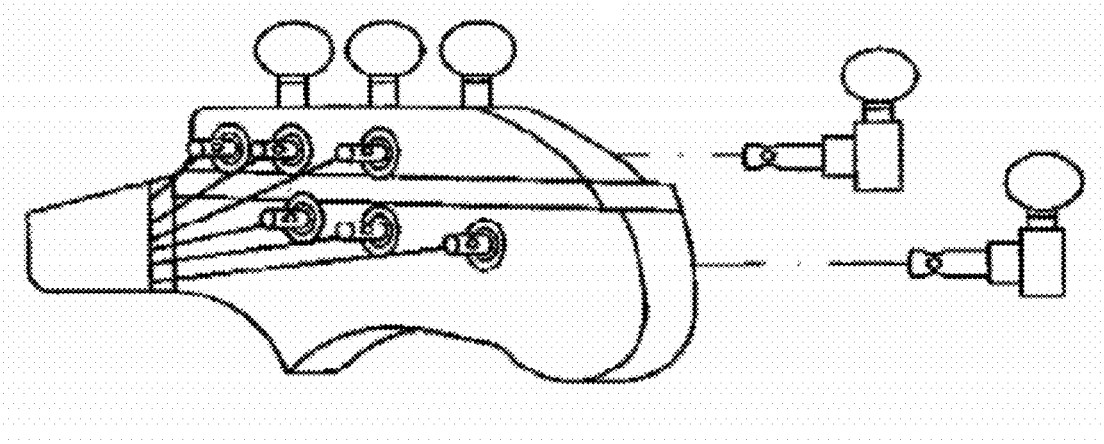
FIG. 16 (Prior Art)
FIG. 16 is a prior art example of a typical thumb knob or flat screw example.

FIG. 16 presents a prior art drawing, FIG. 21 of the McEwen disclosure. No replacement parts or retro fitting for the tuning shafts are contemplated or anticipated in McEwen. While the prior art did insert a string shaft into the back side of a headstock, the flat tuning keys were fixed in place and no means of non-destructive replacement are disclosed. The present invention overcomes many of the shortfalls disclosed in McEwen, as ergonomic tuning orbs may now be retrofitted, non-destructively into completed guitars or other string instruments.

Embodiments of the present disclosure include the use and fabrication of asymmetric or symmetric orb collars 107, wherein the interior vertical void 111 of the orb collar is asymmetric or symmetric so as to fit a tuning shaft 302, wherein the tuning shaft may have one or more flat vertical edge(s) 305. The front flat side 115 of the orb set screw may urge or rest upon a flat vertical edge 305 of the tuning shaft. The top edge 110 of the orb collar may urge or rest upon a top center wall of the interior center vertical void 104 of an orb. The top center wall may be used to define the upper limit of the orb's interior vertical void 104. A friction reducing washer may comprise a washer made of Teflon or similar material.

Items

Embodiments of the present disclosure include, but not limited to the following items. The terms and reference numbers used within the Items do not limit the meaning of terms used within the claims.

Item 1. A kit for retrofitting tuning assemblies 800, the kit comprising a) a friction reducing washer 113;

b) a spring washer, 112, wherein the spring washer is irregularly shaped, so as to not lay flat when placed upon the friction reducing washer 113, and wherein the spring washer deflects, when loaded against a lower edge 109 of an orb collar 107, so as to provide a preload between the spring washer 112 and the lower edge 109 of the orb collar 117;

c) the orb collar 107 comprising the lower edge 109, a main circular pipe body 114, with the main circular pipe body comprising a symmetrical inner wall and symmetrical outer wall, wherein the symmetrical inner wall is formed to fit over one or more flat vertical edges 305 of a tuning shaft 302, the orb collar further having an upper edge 110 and a perpendicular void 108 within the main circular pipe body 114;

d) a tuning orb 100, comprising a round main wall 103, an interior center vertical void 104, a perpendicular void 105, a shoulder 101, and crown 102; and e) an orb set screw 106 comprising a threaded body, a front flat side 115 and a rear side, the rear side having slots to accept a screw driver.

Item 2. An ergonomic tuning assembly, the tuning assembly comprising:

a) a friction reducing washer 113;

b) a spring washer, 112, wherein the spring washer is irregularly shaped, so as to not lay flat when placed upon the friction reducing washer 113, and wherein the spring washer deflects, when loaded against a lower edge 109 of an orb collar 107, so as to provide a preload between the spring washer 112 and the lower edge 109 of the orb collar 117;

c) the orb collar 107 comprising the lower edge 109, a main circular pipe body 114, with the main circular pipe body comprising an symmetrical inner wall and symmetrical outer wall, wherein the symmetrical inner wall is formed to fit over one or more flat vertical edges 305 of a tuning shaft 302, the orb collar further having an upper edge 110 and a perpendicular void 108 within the main circular pipe body 114;

d) a tuning orb 100, comprising a main wall 103, an interior center vertical void 104, a perpendicular void 105, a shoulder 101, and crown 102; and e) an orb set screw 106 comprising a threaded body, a front flat side 115 and a rear side, the rear side having slots to accept a screw driver.

Item 3. The ergonomic tuning assembly of item 2, further comprising:

a) a tuning shaft 302, the tuning shaft having one or more flat vertical edges 305, the tuning shaft connected to a tuning shaft housing 301, the tuning shaft housing connected to a case 300 the case connected to a locking nut 400, the case also being connected to a string attachment shaft housing 506, the string attachment shaft housing attached to a string attachment shaft 500.

Item 4. The ergonomic tuning assembly of item 3, wherein the string attachment shaft 500 comprises an outer collar 501, a recessed winding area for string 502, an inner collar, and a void for string, found within the recessed winding area for string.

Item 5. The ergonomic tuning assembly of item 4, including a headstock bolt 650 and washer 653 for the headstock bolt and wherein the headstock bolt comprises a nut section and a threaded shaft section 651.

Item 6, a method of retrofitting an existing tuning assembly, the steps comprising:

a) removing an existing tuning knob and all means of attachment securing the existing tuning knob to a tuning shaft;

b) using the components from the kit of item 1, placing a friction reducing washer 113 upon the tuning shaft, placing a spring washer 112 upon the tuning shaft and on top of the friction reducing washer, placing an orb collar 107 within a tuning orb 100, aligning a perpendicular void of the orb collar with a perpendicular void of the orb, inserting the tuning shaft into a center void of the orb collar, screwing an orb set screw through the perpendicular voids of the orb and orb collar, until a front section 115 of the orb set screw pushes against the tuning shaft.

While certain aspects of the invention are presented below in certain claim forms, the inventor(s) contemplate the various aspects of the invention in any number of claim forms.

What is claimed is:

1. A kit for retrofitting tuning assemblies, the kit comprising:

a) a friction reducing washer;

b) a spring washer, c) an orb collar comprising a lower edge, a main circular pipe body, the main circular pipe body comprising a symmetrical inner wall and a symmetrical outer wall, wherein the symmetrical inner wall fits one or more flat vertical edges of a tuning shaft, the orb collar further comprising an upper edge and a perpendicular void, the perpendicular void defined by the main circular pipe body;

d) a tuning orb, comprising a round main wall, an interior center vertical void, a perpendicular void, a shoulder, and crown; and e) an orb set screw comprising a threaded body, a front flat side and a rear side, the rear side comprising slots to accept a screw driver.

2. An ergonomic tuning assembly, the tuning assembly comprising:

a) a friction reducing washer;

b) a spring washer, c) an orb collar comprising a lower edge, a main circular pipe body, the main circular pipe body comprising a symmetrical inner wall and a symmetrical outer wall, wherein the symmetrical inner wall fits one or more flat vertical edges of a tuning shaft, the orb collar further comprising an upper edge and a perpendicular void, the perpendicular void defined by the main circular pipe body;

d) a tuning orb, comprising a main wall, an interior center vertical void, a perpendicular void, a shoulder, and a crown;

e) an orb set screw comprising a threaded body, a front flat side and a rear side, the rear side comprising slots to accept a screw driver;

f) a tuning shaft, the tuning shaft comprising one or more flat vertical edges, the tuning shaft connected to a tuning shaft housing, the tuning shaft housing connected to a case, the case connected to a locking nut, the case also connected to a string attachment shaft housing, the string attachment shaft housing attached to a string attachment shaft; and g) the string attachment shaft further comprising an outer collar, a recessed winding area, and an inner collar.

3. The ergonomic tuning assembly of claim 1, including a headstock bolt and a washer the headstock bolt comprising a nut section and a threaded shaft section.

4. A method of retrofitting an existing tuning assembly, the steps comprising:

a) removing an existing tuning knob and all means of attachment securing the existing tuning knob to a tuning shaft; and b) using the components from the kit of claim 1, placing a friction reducing washer upon the tuning shaft, placing a spring washer upon the tuning shaft and on top of the friction reducing washer, placing a orb collar within a tuning orb, aligning a perpendicular void of the orb collar with a perpendicular void of the orb, inserting the tuning shaft into a center void of the orb collar, and screwing an orb set screw through the perpendicular voids of the orb and orb collar, until a front section of the orb set screw pushes against the tuning shaft.

* * * * *